US007396174B2

(12) United States Patent
Hattori

(10) Patent No.: US 7,396,174 B2
(45) Date of Patent: Jul. 8, 2008

(54) RECORDING MEDIUM SUPPLY DEVICE AND IMAGE FORMING DEVICE

(75) Inventor: Makoto Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 205 days.

(21) Appl. No.: 11/052,986

(22) Filed: Feb. 9, 2005

(65) Prior Publication Data

US 2005/0180797 A1 Aug. 18, 2005

(30) Foreign Application Priority Data

Feb. 12, 2004 (JP) ..... 2004-035362

(51) Int. Cl.
*B65H 1/14* (2006.01)
*B65H 1/08* (2006.01)
*B41J 13/10* (2006.01)

(52) U.S. Cl. ..... 400/624; 400/629; 271/127; 271/147; 271/157; 271/162

(58) Field of Classification Search ..... None
See application file for complete search history.

(56) References Cited

U.S. PATENT DOCUMENTS 5,102,112 A * 4/1992 Takahashi ..... 271/9.08
5,228,673 A * 7/1993 Osonoe ..... 271/10.01

FOREIGN PATENT DOCUMENTS

| | | | |
|---|---|---|---|
| JP | 59069326 A | * | 4/1984 |
| JP | U-62-181533 | | 11/1987 |
| JP | A 5-208734 | | 8/1993 |
| JP | 08073055 A | * | 3/1996 |
| JP | A 8-73055 | | 3/1996 |
| JP | A-09-194050 | | 7/1997 |
| JP | A-2001-114424 | | 4/2001 |

* cited by examiner

*Primary Examiner*—Daniel J Colilla
(74) *Attorney, Agent, or Firm*—Oliff & Berridge, PLC

(57) ABSTRACT

A coil spring 103 is wound around a rotational shaft 15 with its one end portion 103*a* being inserted into an engagement groove 100*a* formed in a side wall of a direct-coupled gear 100 and with its other end portion 103*b* being inserted in an engagement groove 93*a* provided in a front wall 93 of a paper cassette 6. The elastic force generated by the coil spring 103 functions as a pressing force for restraining the torque of the rotational shaft 15 that is generated by the driving force from a DC motor 70. The amount of the elastic force increases as the height of a paper pressing plate 8 increases. Accordingly, a variation in the height of the topmost sheet 3, which will possibly occur due to changes in the amount of recording medium 3 placed on a mounting plate 8, can be restrained.

17 Claims, 7 Drawing Sheets

RECORDING MEDIUM SUPPLY DEVICE AND IMAGE FORMING DEVICE

BACKGROUND OF THE INVENTION

1. Field of the Invention

The present invention relates to an image forming device and a recording medium supply device that supplies a recording medium to the main body of the image forming device.

2. Description of Related Art

Japanese Unexamined Patent Application Publication Nos. 5-208734 and 8-73055 disclose a paper-supply device of a type that is provided with a mounting plate, on which is placed a plurality of sheets of paper in a stack, and a lifting or elevating member that pivots upon receiving the driving force of a drive motor to push the mounting plate upward. A controller executes an on/off control of supplying a drive current to the drive motor while monitoring the position of the height of the topmost sheet of paper stacked on the mounting plate. The controller stops supplying the drive current to the drive motor when the height of the topmost sheet of paper reaches a predetermined height that corresponds to a supply port for receiving the sheet of paper from the paper-supply device and for supplying the sheet of paper into an image forming device.

SUMMARY OF THE INVENTION

According to the conventional sheet supply device, however, the height, at which the topmost sheet of paper reaches when the mounting plate finally stops due to the halt of the supply of the drive current, varies according to changes in the amount of paper stacked on the mounting plate. This is because the speed, at which the lifting member moves the mounting plate upward based on the driving force from the drive motor, depends on the amount of paper stacked on the mounting plate because the driving force from the drive motor has a fixed value. That is, the upward speed increases as the amount of paper decreases. The lifting member continues moving the mounting plate upwardly for some period of time after the controller stops supplying the drive current to the motor until the lifting member finally stops moving the mounting plate. Accordingly, the height, at which the topmost sheet of paper finally reaches, varies dependently on changes in the amount of paper stacked on the mounting plate, thereby preventing stable operation of supplying paper.

In view of the above-described drawbacks, it is an objective of the present invention to provide a recording medium supply device and an image forming device that can restrain variations in the height of the topmost sheet of recording medium due to changes in the amount of recording medium stacked on the mounting plate.

In order to attain the above and other objects, the present invention provides a recording medium supply device for supplying a recording medium to a main body of an image forming device so as to allow the image forming device to form an image on the recording medium. The recording medium supply device includes: a supply device casing; a mounting plate; a lifting member; and a pressing member. The mounting plate is supported in the supply device casing and receives a recording medium in a stack thereon. At least a part of the mounting plate is movable vertically with respect to the supply device casing. The lifting member converts a driving force generated by a drive motor into an upward force to cause at least a part of the mounting plate to rise upwardly, thereby raising a topmost recording medium placed on the mounting plate to reach a predetermined target height. The pressing member applies at least one of the mounting plate and the lifting member with a pressing force against the upward force applied on the mounting plate. The strength of the pressing force increases as the at least a part of the mounting plate rises.

According to another aspect, the present invention provides a recording medium supply device for supplying a recording medium to a main body of an image forming device so as to allow the image forming device to form an image on the recording medium. The recording medium supply device includes: a supply device casing; a mounting plate; a lifting member; and a pressing member. The mounting plate is supported in the supply device casing and receives a recording medium in a stack thereon, at least a part of the mounting plate being movable vertically with respect to the supply device casing. The lifting member converts a driving force generated by a drive motor into an upward force to cause at least a part of the mounting plate to rise upwardly, thereby raising a topmost recording medium placed on the mounting plate to reach a predetermined target height. The pressing member applies at least one of the mounting plate and the lifting member with a pressing force against the upward force applied on the mounting plate, a sum of the total weight of the recording medium and the pressing force having a fixed amount regardless of changes in the total weight of the recording medium placed on the mounting plate when a height, at which the topmost recording medium is positioned, is unchanged.

According to another aspect, the present invention provides an image forming device, including: a main unit that forms an image on a recording medium; and a recording medium supply device that supplies the recording medium to the main unit. The recording medium supply device includes: a supply device casing; a mounting plate: a lifting member; and a pressing member. The mounting plate is supported in the supply device casing and receives a recording medium in a stack thereon, at least a part of the mounting plate being movable vertically with respect to the supply device casing. The lifting member converts a driving force generated by a drive motor into an upward force to cause at least a part of the mounting plate to rise upwardly, thereby raising a topmost recording medium placed on the mounting plate to reach a predetermined target height. The pressing member applies at least one of the mounting plate and the lifting member with a pressing force against the upward force applied on the mounting plate, the strength of the pressing force increasing as the at least a part of the mounting plate rises. The drive motor is provided in either one of the main unit and the recording medium supply device. The drive motor device generates a driving force. A control device is provided in either one of the main unit and the recording medium supply device, the control device controlling the drive motor to stop generating the driving force when the topmost recording medium placed on the mounting plate reaches the predetermined target height.

BRIEF DESCRIPTION OF THE DRAWINGS

The above and other objects, features and advantages of the invention will became more apparent from reading the following description of the preferred embodiments taken in connection with the accompanying drawings in which.

DETAILED DESCRIPTION OF THE PREFERRED EMBODIMENT

Next, a laser printer according to an embodiment of the present invention will be described with reference to the accompanying drawings.

Figure 1:
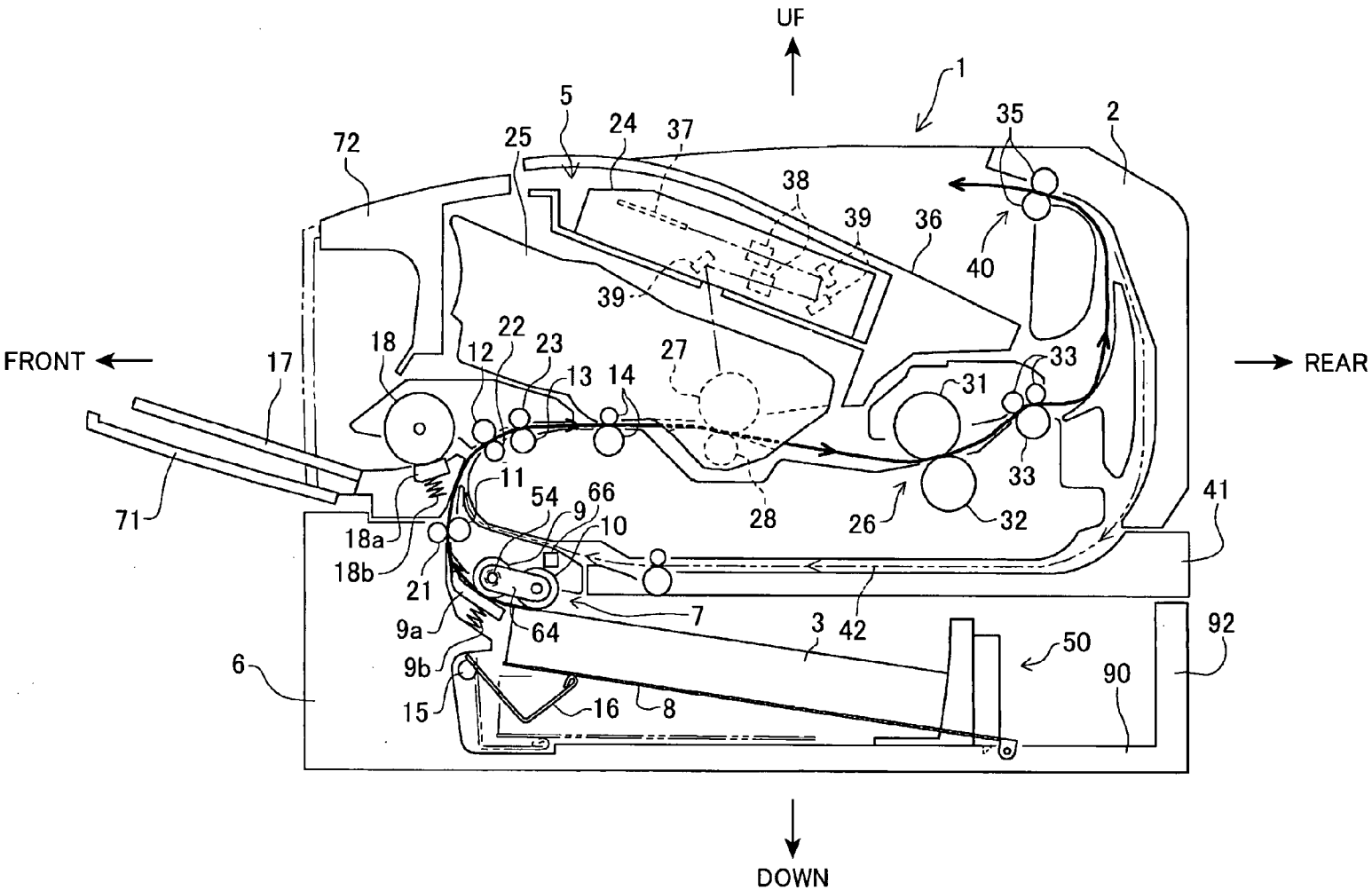
FIG. 1 is a side sectional view showing the general construction of a laser printer and a paper cassette used in the laser printer according to an embodiment of the present invention.

The laser printer 1 shown in FIG. 1 is an electrophotographic type printer capable of performing duplex printing. As shown in FIG. 1, the laser printer 1 includes a separating/feeding section 7 for feeding sheets of paper 3, and an image-forming section 5 for forming images on the paper 3 supplied from the separating/feeding section 7.

In the following description, upstream or downstream in a sheet feed direction in which the paper 3 is conveyed will be abbreviated as simply "upstream" or "downstream". Also, the expression "front", "rear", "left", "right", "upper", "below" are used throughout the description to define the various parts when the printer 1 is disposed in an orientation in which it is intended to be used.

As shown in FIG. 1, the laser printer 1 includes a main casing 2. A paper cassette 6 having an open-top box shape is mounted in a bottom section of the main casing 2. The separating/feeding section 7 is disposed in one end of the paper cassette 6 near the front of the main casing 2.

A paper pressing plate 8 is disposed inside the paper cassette 6. The paper pressing plate 8 is capable of mounting a stack of paper 3 thereon and disposed in opposition to the separating/feeding section 7 via the stack of paper 3.

As is described later, the paper cassette 6 is slidably supported in the main casing 2. To load paper, the paper cassette 6 is pulled out through the front of the main casing 2, exposing an area including the paper pressing plate 8. After loading paper 3 on the paper pressing plate 8, the paper cassette 6 is slid back into the main casing 2 by pushing the paper cassette 6 toward the rear of the main casing 2. Further, the paper cassette 6 can be completely removed from the main casing 2 when pulling the paper cassette 6 out through the front.

Provided downstream of the separating/feeding section 7 are a first conveying roller 11, a second conveying roller 12, and a third conveying roller 13 in order from upstream to downstream. A pair of registration rollers 14 is disposed downstream of the third conveying roller 13.

Paper dust collecting rollers 21, 22, and 23 are disposed in confrontation with the first through third conveying rollers 11-13, respectively. Each of the paper dust collecting rollers 21, 22, and 23 includes a roller having a surface conducive to electrical charging, such as a roller formed of a fluorocarbon resin or a roller having a surface coated with fluorine, for example. The paper dust collecting rollers 21, 22, and 23 electrostatically attract and remove paper dust deposited on the paper 3 to prevent the paper dust from mixing with toner in the image-forming section 5 described later, which can lead to a deterioration in printing quality.

The separating/feeding section 7 includes a pickup roller 10, a separating roller 9 disposed downstream of the pickup roller 10, and a separating pad 9*a* confronting the separating roller 9. The pickup roller 10 and the separating roller 9 are disposed on the main casing 2 side, while the separating pad 9*a* is provided on the paper cassette 6 side. An urging spring 9*b* is provided on the separating pad 9*a*. The elastic force of the urging spring 9*b* presses the separating pad 9*a* against the separating roller 9.

More specifically, the separating roller 9 is integrally fixed to a drive shaft 54. The separating roller 9 is driven to rotate by a driving force communicated to the drive shaft 54, as will be described later. One end of a support arm 64 is mounted on the drive shaft 54 so that the support arm 64 can swing about the axis of the drive shaft 54. The pickup roller 10 is rotatably supported on the free end of the support arm 64. The support arm 64 is not urged by any spring, but the pickup roller 10 is urged by its own weight toward an upper surface of the uppermost paper 3 mounted on the paper pressing plate 8.

The sheet pressing plate 8 is capable of supporting a stack of paper 3 thereon. The sheet pressing plate 8 is pivotably supported at its end furthest from the separating roller 9 (rear end) so that the end of the sheet pressing plate 8 that is nearest the separating roller 9 (front end of the sheet pressing plate 8) can move upward and downward. The support arm 64 swings about the drive shaft 54 upward and downward as the front end of the sheet pressing plate 8 moves upward and downward.

A rotational shaft 15 is supported in the paper cassette 6 below the separating roller 9. An L-shaped pressing member 16 is affixed to the rotational shaft 15 such that the free end of the pressing member 16 is inserted below the paper pressing plate 8. The rotational shaft 15 is driven by a pressing plate drive unit GB (FIGS. 2 and 3) described later, which includes a direct-current (DC) motor 70 and a gear train. By driving the rotational shaft 15 with the pressing plate drive unit 68, the pressing member 16 is pushed upward against the bottom surface of the paper pressing plate 8, causing the paper pressing plate 8 to pivot upward about the rear end, which is the end farthest from the separating/feeding section 7. As a result, the front end of the paper pressing plate 8 moves in a direction toward the separating/feeding section 7.

When the paper pressing plate 8 is driven (moved) upward by the pressing plate drive unit 68, the paper 3 stacked on the paper pressing plate 8 is pushed against the pickup roller 10.

The pickup roller 10 conveys the uppermost sheet of the paper 3 toward the separating roller 9 so that the paper 3 becomes interposed between the separating pad 9*a* and the separating roller 9. Through the cooperative operations of the separating pad 9*a* and the separating roller 9, the paper 3 is separated and fed one sheet at a time.

A detecting sensor 66 is provided near the support arm 64, which supports the pickup roller 10. The detecting sensor 66 outputs an OFF signal when the pickup roller 10 is lower than a height corresponding to a target height, and issues an ON signal when the pickup roller 10 reaches the height corresponding to the target height. It is noted that when the pickup roller 10 is at the height corresponding to the target height, the uppermost paper 3 on the sheet pressing plate 8 is located at the predetermined target height, from which the uppermost paper 3 can be properly conveyed into between the separating roller 9 and the separating pad 9*a*.

The detecting sensor 66 detects a decline in the amount of the paper 3 stacked on the paper pressing plate 8 by sensing the position of the topmost sheet of the paper 3 on the paper pressing plate B. In other words, when the amount of paper 3 stacked on the paper pressing plate 8 declines as the separating/feeding section 7 is driven to feed the paper 3 one sheet at a time, the pickup roller 10 contacting the top of the topmost sheet of paper 3 gradually lowers.

The detecting sensor 66 turns OFF and sends an OFF signal to a controller 67 (FIG. 3) in the pressing plate drive unit 68 when detecting that the pickup roller 10 has fallen below the height corresponding to the target height, that is, when the position of the topmost sheet of the paper 3 becomes lower than the target position. Receiving the OFF signal from the detecting sensor 66, the controller 67 determines that the amount of paper 3 stacked on the paper pressing plate 8 has declined, and then supplies a driving current to the DC motor 70 at a prescribed timing to raise the paper pressing plate 8.

The detecting sensor 66 turns ON and sends an ON signal to the controller 67 when detecting that the pickup roller 10 reaches the height corresponding to the target height. Receiving the ON signal from the detecting sensor 66, the controller 67 determines that the position of the topmost sheet of the paper 3 reaches the target position, and then stops supplying a driving current to the DC motor 70, thereby stopping driving of the DC motor 70.

Representative examples of the detecting sensor 66 include: a magnetic sensor and a photoelectric sensor. When the detecting sensor 66 is a reflection type photoelectric sensor, the detecting sensor 66 has: a light emitting portion for emitting light to the pickup roller 10; and a light receiving portion for receiving a part of the light that is reflected from the pickup roller 10. When the pickup roller 10 is at the height corresponding to the target height, the amount of the reflected light received by the light receiving portion has such a value that is greater than or equal to a predetermined threshold value.

The paper 3 fed by the separating/feeding section 7 is received and conveyed in succession by the first through third conveying rollers 11-13 and supplied to the pair of registration rollers 14. The pair of registration rollers 14 performs a desired registration operation on the supplied paper 3 and transports the same to the image forming section 5.

A multipurpose tray 17 is disposed on the front of the laser printer 1. The multipurpose tray 17 can be opened and closed, and paper 3 of a desired size can be stacked on the multipurpose tray 17 in the open position. A multipurpose feeding roller 18 is disposed near the multipurpose tray 17 for feeding the paper 3 from the stack on top of the multipurpose tray 17. A multipurpose separating pad 18*a* is provided in confrontation with the multipurpose feeding roller 18. A spring 18*b* presses the multipurpose separating pad 18*a* against the multipurpose feeding roller 18.

A first cover 71 is swingably mounted on the front surface of the laser printer 1. Placing the multipurpose tray 17 and the first cover 71 in a closed position when not using the multipurpose tray 17 provides a neat appearance to the front surface of the laser printer 1 and protects the multipurpose feeding roller 18, the multipurpose separating pad 18*a*, and other internal components.

With this construction, paper (not shown) loaded on the multipurpose tray 17 becomes interposed between the multipurpose feeding roller 18 and the multipurpose separating pad 18*a* and is separated and supplied one sheet at a time through the cooperative operations of the multipurpose feeding roller 18 and the multipurpose separating pad 18*a*. Paper fed from the multipurpose tray 17 is conveyed to the registration rollers 14 by the second and third conveying rollers 12 and 13.

The image forming section 5 includes a scanner section 24, a process cartridge 25, and a fixing section 26. The scanner section 24 is provided in the upper section of the main casing 2 and is provided with a laser emitting section (not shown), a rotatingly driven polygon mirror 37, lenses 38, and reflection mirrors 39. The laser emitting section emits a laser beam based on desired image data. As indicated by dot chain line in FIG. 1, the laser beam passes through or is reflected so as to irradiate, in a high speed scanning operation, the surface of a photosensitive drum 27 of the process cartridge 25.

The process cartridge 25 is detachably mounted in the main casing 2 at a position below the scanner section 24. The process cartridge 25 includes the photosensitive drum 27 and a transfer roller 28 disposed in confrontation with the photosensitive drum 27. Although not shown in the drawings, the process cartridge 25 further includes a scorotron charger, a toner hopper, a developing roller, a thickness-regulation blade, and a toner-supply roller. A second cover 72 is disposed at the front on the upper surface of the main casing 2 so as to be freely pivotable. The process cartridge 25 can be mounted in and removed from the main casing 2 by opening the second cover 72.

The toner hopper is filled with positively charging, non-magnetic, single-component toner as a developer. The toner is carried on the developing roller as a thin layer of toner having a uniform thickness on the developing roller.

The photosensitive drum 27 shown in FIG. 1 is rotatably supported in confrontation with the developing roller. The photosensitive drum 27 has a main body that is grounded. The surface of the main body is a positively-charging photosensitive layer formed of polycarbonate or the like.

As the photosensitive drum 27 rotates, the scorotron charger forms a uniform positive charge over the surface of the rotating photosensitive drum 27. Subsequently, a laser light emitted from the scanner section 24 scans across the surface of the photosensitive drum 27 at a high speed, so that electrostatic latent images are formed on the surface of the photosensitive drum 27 in accordance with image data. Then, the positively charged toner carried on the surface of the developing roller is brought into contact with the photosensitive drum 27. At this time, the toner is selectively attracted to portions of the photosensitive drum 27 that have been exposed to the laser beam and, therefore, have a lower potential than the rest of the surface having a uniform positive charge, thereby transforming the latent images formed on the surface of the photosensitive drum 27 into toner images. In this way, development is achieved.

The transfer roller 28 is rotatably supported in the process cartridge 25 at a position below and in confrontation with the photosensitive drum 27.

The toner image carried on the surface of the photosensitive drum 27 is transferred to the paper 3 as the paper 3 passes between the photosensitive drum 27 and the transfer roller 26. The paper 3 formed with the toner image in this manner is conveyed to the fixing section 26 by a conveying belt and the like (not shown).

The fixing section 26 includes a heat roller 31 disposed downstream of the process cartridge 25, a pressure roller 32 disposed in confrontation with the heat roller 31, and convey rollers 33 disposed downstream of the heat roller 31 and the pressure roller 32.

The heat roller 31 is made of metal and houses a halogen lamp for generating heat. With this configuration, toner transferred onto the paper 3 at the process cartridge 25 is thermally fixed onto the paper 3 as the paper 3 passes between the heat roller 31 and the pressure roller 32. Afterwards, the convey rollers 33 convey the paper 3 to discharge rollers 35 disposed on the main casing 2. The discharge rollers 35 convey and discharge the paper 3 onto a discharge tray 36 provided on the upper surface of the main casing 2 through a discharge port 40.

A reconveying unit (auxiliary slide unit) 41 for forming images on both sides of the paper 3 is detachably mounted on the main casing 2 through insertion above the paper cassette 6. A reconveying path 42 is formed in the reconveying unit 41 and in the upper rear section of the main casing 2 for reconveying the paper 3 to the image-forming section 5 when performing duplex printing.

In a duplex printing process performed in the laser printer 1 having the construction described above, the paper 3 initially passes through the image-forming section 5, wherein an image is formed on one side of the paper 3, and is conveyed to the discharge rollers 35. Subsequently, the paper 3 interposed between the discharge rollers 35 is reversed by the same and conveyed back to the image-forming s section 5 via the reconveying path 42. In the image-forming section 5, an image is formed on the other side of the paper 3. The reconveying unit 41 can slide in and out of the rear section of the device to facilitate removing paper 3 that has become jammed in the reconveying path 42.

Figure 2:
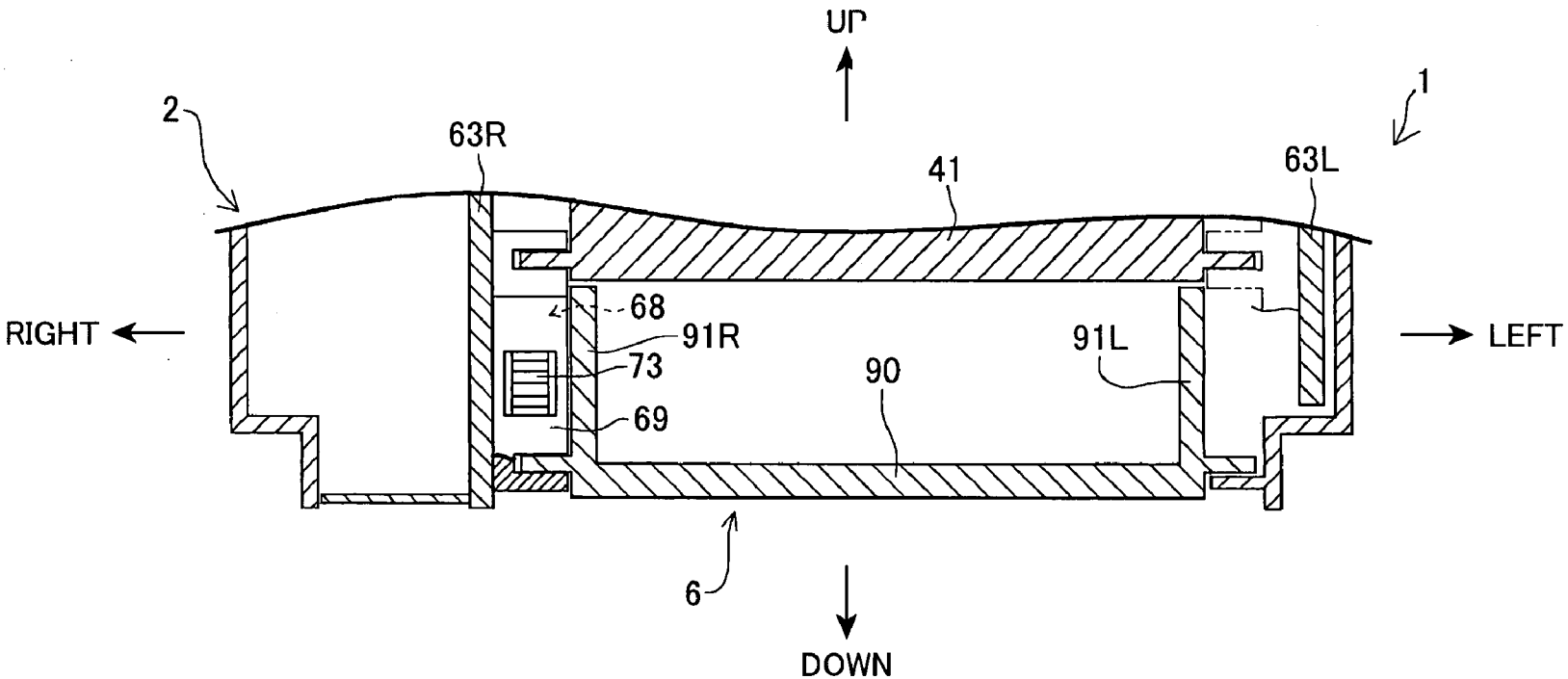
FIG. 2 is a front cross-sectional view showing the bottom cross-section of the laser printer in FIG. 1.

As shown in FIG. 2, a left-side frame 63L and a right-side frame 63R formed of metal plates are provided on the left and right sides of the main casing 2. The paper cassette 6 is mounted inside the main casing 2 by slidingly inserting the paper cassette 6 between the frames 63L and 63R.

Figure 3:
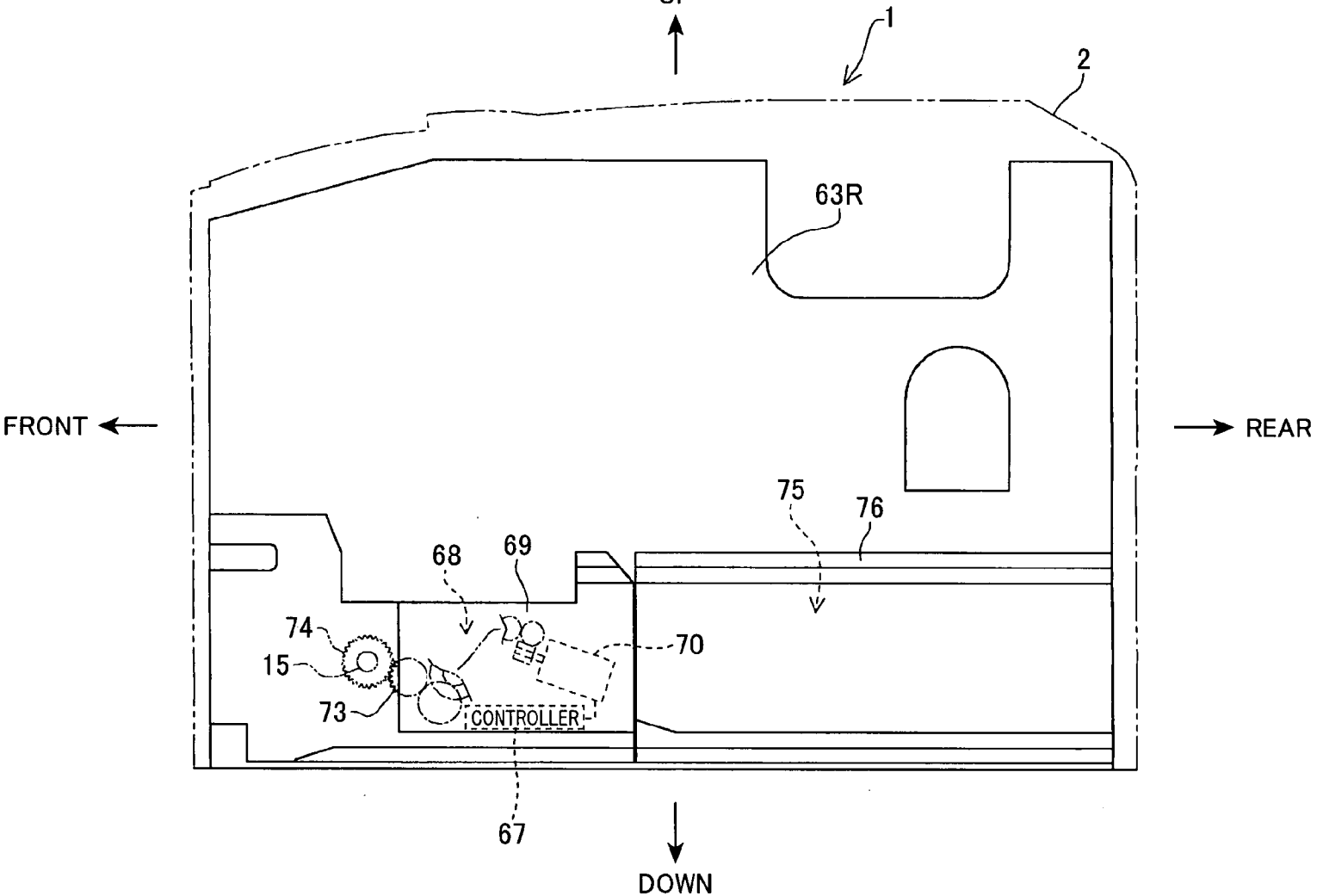
FIG. 3 is a side sectional illustration briefly showing the construction of a pressing plate drive unit and a main motor unit provided on an inner surface of a right-side frame and viewed from an inner side of the laser printer of FIG. 1.

As shown in FIGS. 2 and 3, the pressing plate drive unit 68 is mounted on the front inner surface of the right-side frame 63R. The pressing plate drive unit 68 includes the controller 67, the DC motor 70, an output gear 73, and a gear train linking the DC motor 70 and the output gear 73.

The pressing plate drive unit 68 is covered by a drive unit cover 69 formed of a synthetic resin. The controller 67, the DC motor 70, the output gear 73, the gear train, and other components of the pressing plate drive unit 68 are either supported on or fixed to the drive unit cover 69. A portion of the output gear 73 is exposed through the front surface of the drive unit cover 69 in order to engage with an input gear 74 (described later) in the paper cassette 6.

As shown in FIG. 3, a main motor unit 75 is mounted on the rear inner surface of the right-side frame 63R adjacent to the pressing plate drive unit 68. The main motor unit 75 includes a main motor and a gear train for driving all the rollers provided in the separating/feeding section 7, in the image-forming section 5, and along the paper conveying path (not shown in FIG. 3). The main motor unit 75 includes a motor unit cover 76 formed of a synthetic resin.

Figure 4:
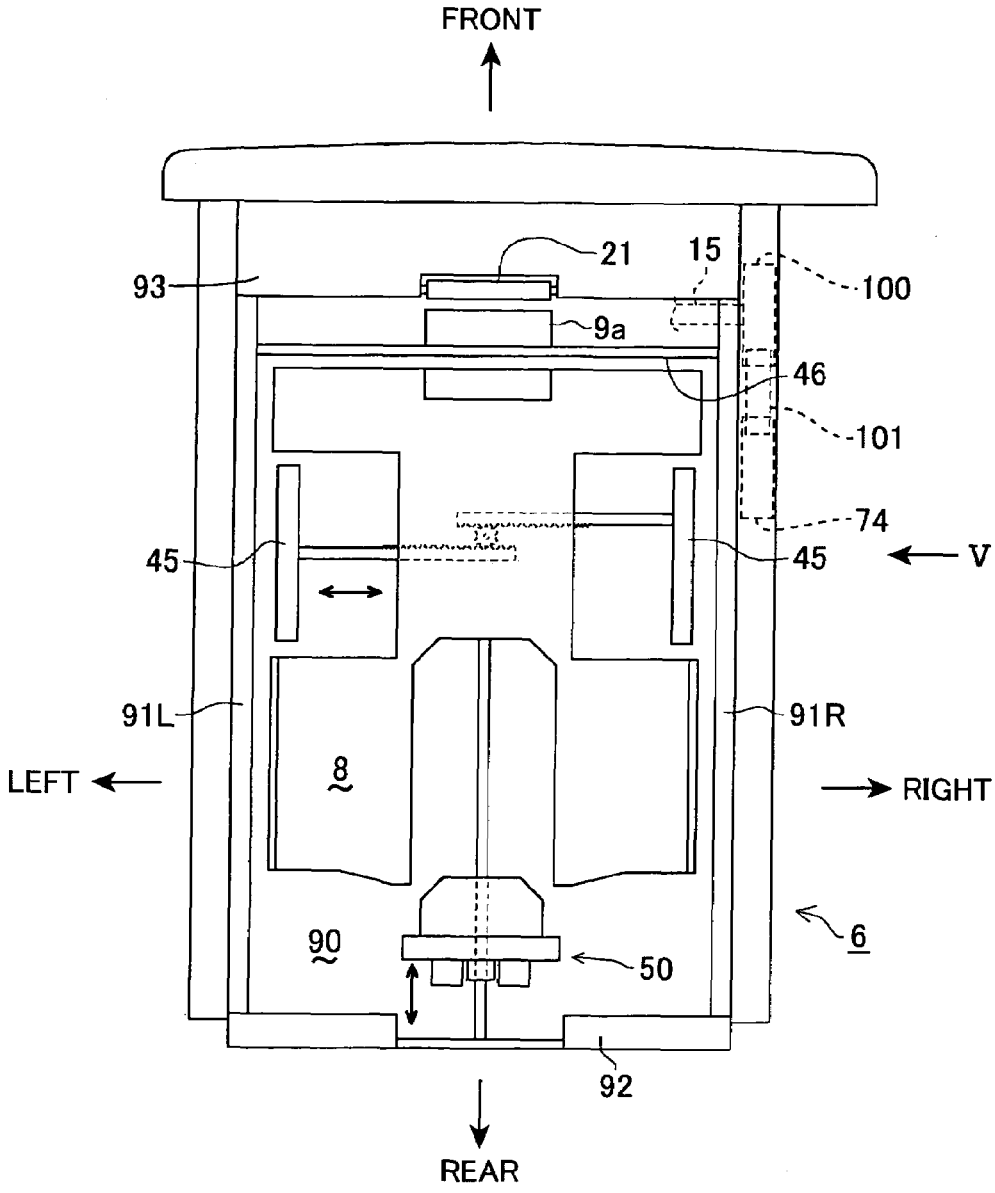
FIG. 4 is a plan view showing the paper cassette, which is removed away from the laser printer of FIG. 1.
Figure 5:
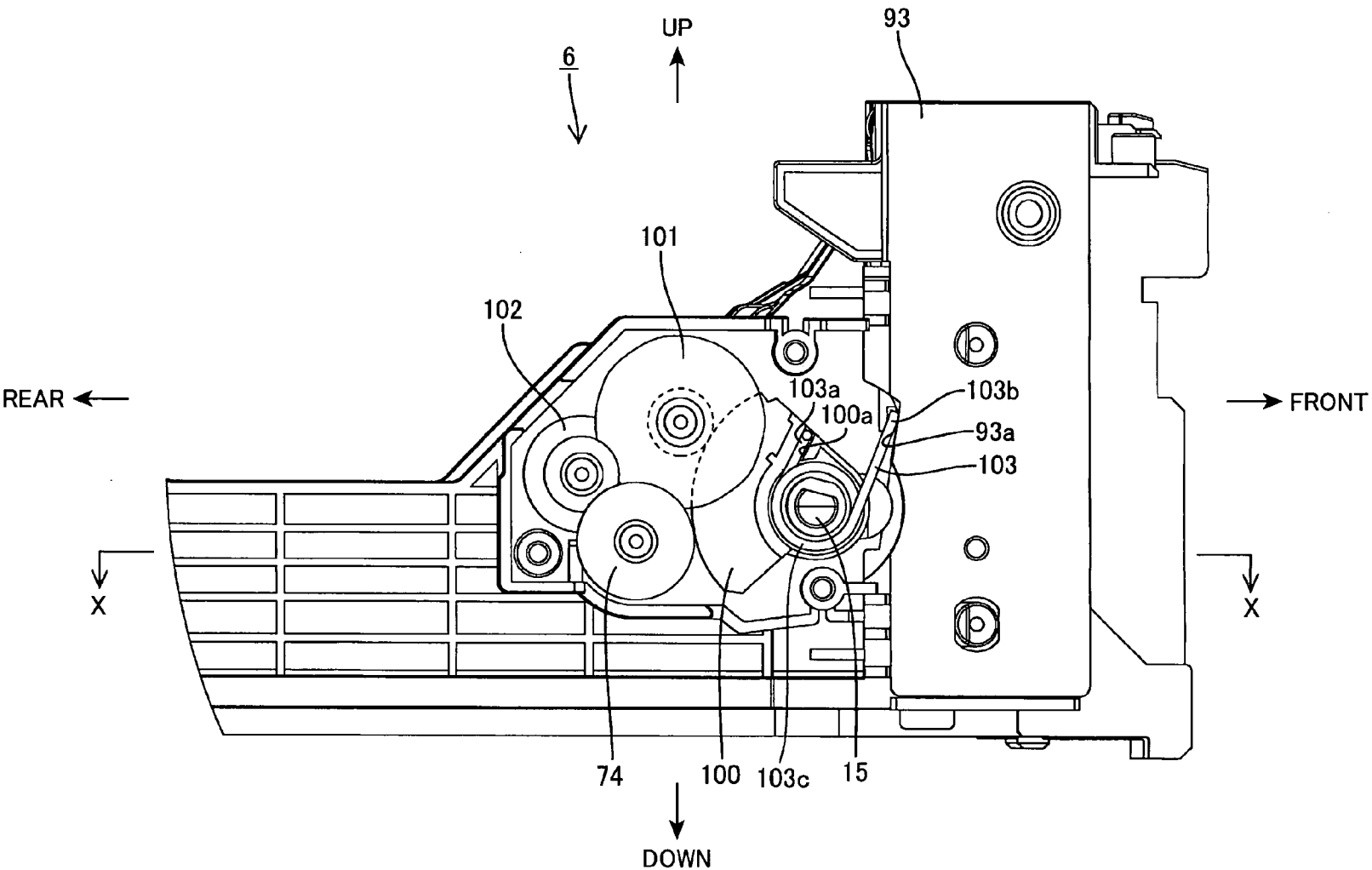
FIG. 5 is an enlarged side view of a part of a right-side surface of the paper cassette, on which a power transmission mechanism is mounted, as being viewed from a direction V in FIG. 4.

As shown in FIGS. 4 and 5, the paper pressing plate 8 is disposed above a bottom plate 90 of the paper cassette 6 and is capable of pivoting about a horizontal axis. A left 15 wall 91L and a right wall 91R are vertically erected from the left and right edges of the bottom plate 90, while a rear wall 92 is vertically erected from the rear edge of the bottom plate 90. A front wall 93 is vertically erected from the front edge of the bottom plate 90.

As shown in FIG. 4, the paper cassette 6 also includes side guides 45 for guiding the side edges of the paper 3 stacked on the paper pressing plate 8 and a rear guide 50 for guiding the rear edge of the paper 3. The positions of the side guides 45 and the rear guide 50 can be adjusted by moving the side guides 45 reciprocatingly in a lateral direction and the rear guide 50 in the front-to-rear direction in order to load various sizes of the paper 3. A reference wall 46 is provided on the front side of the paper pressing plate 8, and the leading edge of the paper 3 is always butted against the reference wall 46. Hence, the paper 3 can be stacked in a prescribed position on the paper pressing plate 8, with the leading edge contacting the reference wall 46, the rear edge contacting the rear guide 50, and the side edges contacting the side guides 45.

As shown in FIG. 4, the rotational shaft 15 passes through the right wall 91R and projects to the right. A direct-coupled gear 100 is fixed to this projecting end. In other words, the direct-coupled gear 100 is directly coupled to the rotational shaft 15. The direct-coupled gear 100 rotates integrally with the rotational shaft 15. The direct-coupled gear 100 is formed in the shape of a sector or fan, with teeth being formed along a circular-arc peripheral side surface thereof as shown in FIG. 5. The input gear 74 is provided to the rear of the direct-coupled gear 100. Two intermediate reduction gears 101 and 102 are provided between the input gear 74 and the direct-coupled gearwheel 100. The intermediate reduction gears 101 and 102 are for linking the gears 74 and 100 with each other. In this way, the gears 100, 101, 102, and 74 are mounted on the right side of the cassette 6.

When the paper cassette 6 is inserted and set into the main casing 2, the input gear 74 engages with the output gear 73 in the pressing plate drive unit 68 as shown by broken lines in FIG. 3. When the DC motor 70 is driven in this state, the driving force thereof is transferred to the output gear 73 through the gear train to cause the output gear 73 to rotate, and the input gear 74 that engages with the output gear 73 also rotates. This rotation of the input gear 74 is reduced by the intermediate gears 101 and 102, and causes the direct-coupled gear 100 and the rotational shaft 15 to rotate together (in the clockwise direction in FIG. 5 (counterclockwise direction in FIG. 1)), which in turn causes the pressing member 16 to press against the lower surface of the paper pressing plate 8 and raise the paper pressing plate 8, thereby pressing the papers 3 that are stacked onto the paper pressing plate 8 against the pickup roller 10.

A coil spring 103 is provided as a pressing mechanism for applying the direct-coupled gear 100 with a pressing force, which is for restraining the force that pushes the paper pressing plate 8 upwards based on the driving force from the DC motor 70, and whose amount increases as the paper pressing plate 8 rises.

Figure 6:
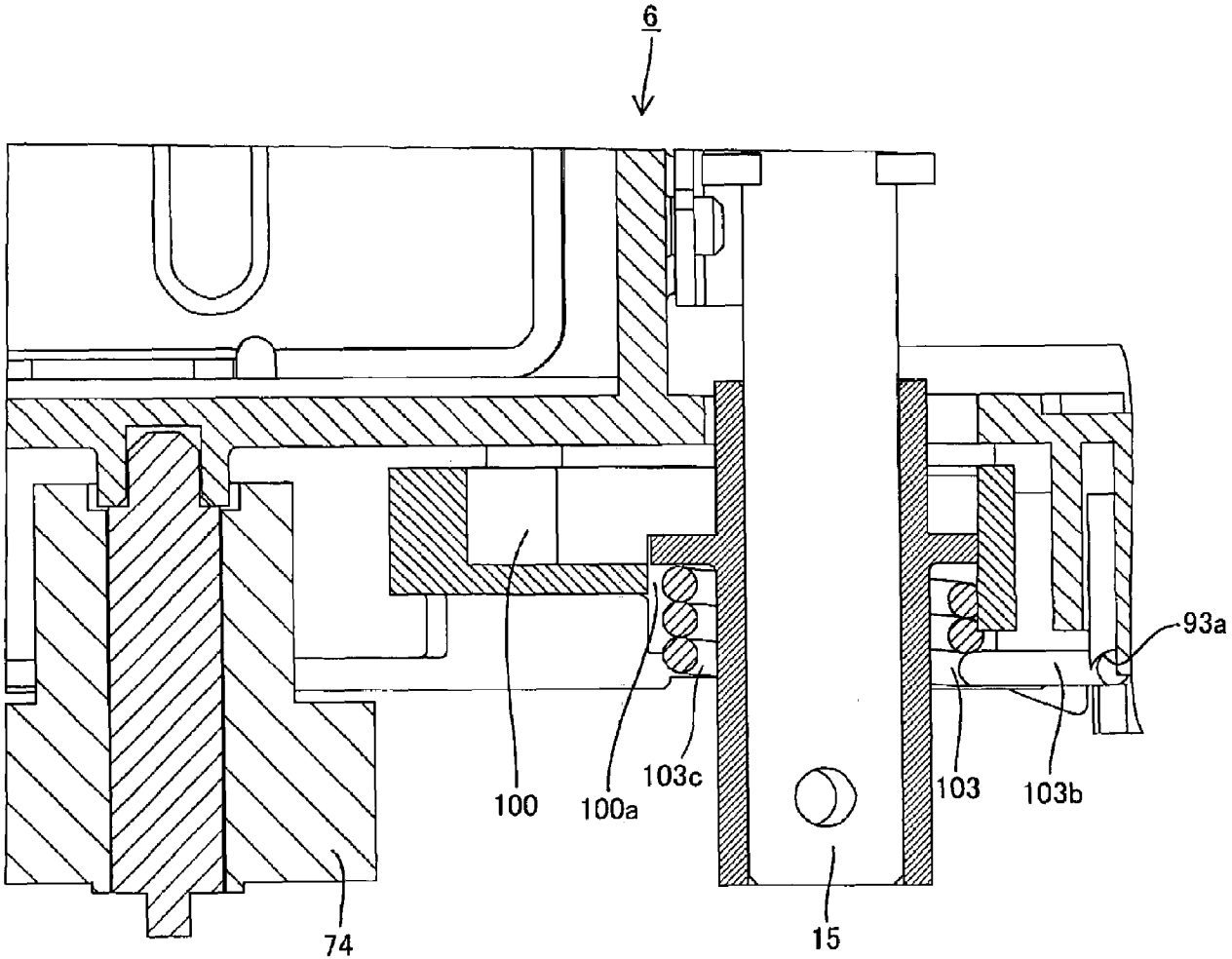
FIG. 6 is a horizontal sectional view of the power transmission mechanism, taken along a line X-X in FIG. 6.

The coil spring 103 (torque spring) is a metal wire that is wound helically around the rotational shaft 15 as shown in FIGS. 5 and 6. The coil spring 103 has two end portions 103*a* and 103*b* and a wound portion 103*c* that is wound around the rotational shaft 15. The end portions 103*a* and 103*b* extend in tangential directions of an outer periphery of the wound portion 103*c* and substantially in the same direction with each other.

As shown in FIG. 5 and FIG. 6, an engagement groove 100*a* is formed in a right-side wall of the direct-coupled gear 100 that faces the right-side frame 63R. Another engagement groove 93*a* is provided on a surface of the front wall 93 that faces rearwardly. The coil spring 103 is mounted on the paper cassette 6, with the wound portion 103*c* being wound around the rotational shaft 15, with the end portion 103*a* being inserted into the engagement groove 100*a* on the direct-coupled gear 100, and with the other end portion 103*b* being inserted in the other engagement groove 93*a* on the front wall 93. The engagement of the end portion 103*a* to the engagement groove 100*a* fixes the coil spring 103 to the direct-coupled gear 100 and to the rotational shaft 15 with respect to the peripheral direction (both clockwise and counterclockwise) of the rotational shaft 15. The engagement of the end portion 103*b* to the engagement groove 93*a* fixes the coil spring 103 to the front wall 93 also with respect to the peripheral direction (both clockwise and counterclockwise) of the rotational shaft 15.

Figure 7:
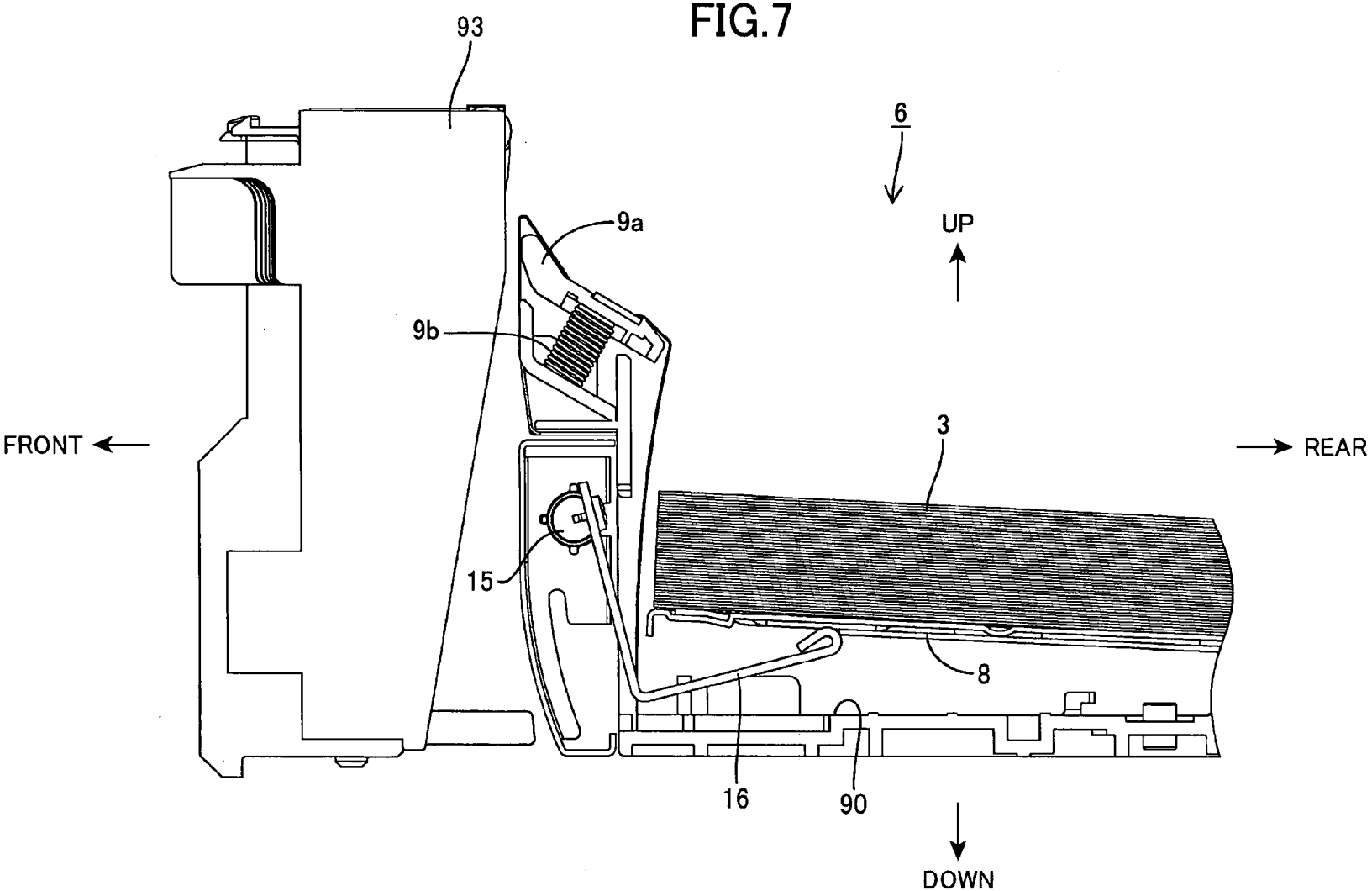
FIG. 7 is a side view of the configuration of a lifting mechanism.

FIG. 7 shows the state of the paper pressing plate 8 and the pressing member 16 when the maximum number of sheets of the maximum size of the paper 3 that can be placed on the paper pressing plate 8 (A4 size, in this example) is placed thereon and the paper cassette 6 is removed from the main casing 2, in other words, when the engagement between the output gear 73 and the input gear 74 is released. In this case, a force established by the total weight of the sheets 3 and the paper pressing plate 8 acts on the pressing member 16 in a direction to push the pressing member 16 downward, thereby acting on the rotational shaft 15 in a direction to rotate the rotational shaft 15 clockwise in FIG. 7 (counterclockwise in FIG. 5). However, the elastic or resilient force of the coil spring 103 acts on the rotational shaft 15 in a direction to rotate the rotational shaft 15 counterclockwise in FIG. 7 (clockwise in FIG. 5). The balance between the force established by the total weight of the sheets 3 and the paper pressing plate 8 and the resiliency force of the coil spring 103 holds the pressing member 16 at a predetermined position that is spaced away from the bottom plate 90 of the paper cassette 6.

The paper cassette 6 is installed into the main casing 2 in the state shown in FIG. 7, and the input gear 74 is made to engage with the output gear 73. At this time, the position of the sheet of paper 3 that is at the topmost position as detected by the detecting sensor 66 is lower than the predetermined target height. Accordingly, the DC motor 70 rotates at a certain driving force. By the driving force, the rotational shaft 15 rotates clockwise in FIG. 5 and the pressing member 16 pushes the paper pressing plate 8 upward. While the rotational shaft 15 is rotating clockwise in FIG. 5, the coil spring 103 deforms elastically so that the end portions 103*a* and 103*b* approach toward each other between the direct-coupled gear 100 and the front wall 93. The elastic force of the coil spring 103 serves to restrain the torque of the rotational shaft 15 that occurs based on the driving force from the DC motor 70. The amount of the elastic deformation of the coil spring 103 increases as the amount of inclination of the pressing member 16 increases. In other words, the amount of the elastic deformation of the coil spring 103 increases as the height of the paper pressing plate 8 increases. This means that the pressing force of the coil spring 103 for restraining the torque of the rotational shaft 15 generated by the driving force from the DC motor 70 increases as the height of the paper pressing plate 8 increases. When the detecting sensor 66 detects that the position of the sheet of paper 3 at the topmost position reaches the target position, the controller 67 stops supplying drive current to the DC motor 70.

It is noted that some length of time is required after the controller 67 stops supplying the drive current to the DC motor 70 and until the paper pressing plate 8 finally stops moving upwardly.

Now assume a comparative configuration in which the coil spring 103 is not provided. Consider the amount of paper 3 stacked onto the paper pressing plate 8. Also consider the upward speed at which the paper pressing plate 8 moves upwardly when the position of the topmost sheet of paper 3 reaches the predetermined target height. In the comparative configuration, as the stack amount of paper 3 decreases, the upward speed will increase. Changes in the stack amount of paper 3 would therefore cause variations in the position, at which the topmost sheet of paper 3 on the paper pressing plate 8 finally stops after halting of the supply of the drive current to the DC motor 70. The position, at which the topmost sheet of paper 3 on the paper pressing plate 8 finally stops, would vary while sheets of the paper 3 are being successively taken from the paper pressing plate 8 to be printed. Especially, because the DC motor 70 is used in the present embodiment, the variation in the height of the topmost sheet of paper 3 becomes larger in comparison with the case where a stepping motor is used in place of the DC motor 70.

According to the present embodiment, the elastic force of the coil spring 103 increases as the height of the paper pressing plate 8 increases. It is also noted that as the stack amount of paper 3 on the paper pressing plate 8 increases, the height, at which the paper pressing plate 8 is located when the topmost sheet of paper 3 reaches the predetermined target height, becomes lower. Accordingly, as the stack amount of paper 3 on the paper pressing plate 8 decreases, the elastic force, which is generated by the coil spring 103 when the topmost sheet of paper 3 reaches the predetermined target height, increases. Accordingly, the elastic force of the coil spring 103 can restrain variations in the height of the topmost sheet of paper 3 due to the changes in the amount of paper 3 stacked on the paper pressing plate 8.

Consider the sum (total force) of the total weight of the paper 3 stacked on the paper pressing plate 8 and the elastic force generated by the coil spring 103 when the topmost sheet of paper 3 reaches some height. According to the present embodiment, the coil spring 103 has such an elastic modulus that when the height, at which the topmost sheet of paper 3 is positioned, is constant, the amount of the total force will not change even though the total weight of the paper 3 stacked on the paper pressing plate 8 changes. More specifically, the elastic force of the coil spring 103 increases linearly with decrease in the total stack weight of the paper 3, provided the topmost sheet of paper 3 is at the same height. This ensures that when the topmost sheet 3 reaches the target height, the paper pressing plate 8 rises at a speed that is unchanged irrespective of the amount of paper 3 stacked on the paper pressing plate 8, thereby restraining variations in the height of the topmost sheet of paper 3 that will possibly occur due to changes in the amount of paper 3 stacked on the paper pressing plate 8.

More specifically, the coil spring 103 has such an elastic modulus that if the topmost sheet of paper 3 is at the same height, the elastic force generated by the coil spring 103 will increase linearly as the total stack weight of the paper 3 decreases from the maximum total weight of paper 3 that is mountable on the paper pressing plate 8. It is noted that the allowable maximum total weight of paper 3 is determined on the basis of: the weight of paper 3 of the maximum size that can be placed on the paper pressing plate 8 (A4 size, in this example); and the maximum number of sheets 3 that can be mounted on the paper pressing plate 8. This ensures that the coil spring 103 can attain great advantages described above when papers of any sizes are stacked on the paper pressing plate 8.

According to the present embodiment, the coil spring 103 having a simple configuration is provided on the direct-coupled gear 100, which is for transmitting the driving force from the DC motor 70 to the rotational shaft 15.

Moreover, since the coil spring 103 is wound around the rotational shaft 15, the coil spring 103 can be mounted within a small space.

The coil spring 103 deforms elastically against the rotational force of the direct-coupled gear 100, with which the direct-coupled gear 100 rotates integrally with the rotational shaft 15 by a rotating amount smaller than one rotation (360 degrees) within the vertical movement range of the paper pressing plate 8. The coil spring 103 has a relatively simple configuration to generate the linearly-changing elastic force, in comparison with a comparative configuration in which the coil spring 103 were provided on another gear that rotates more than one rotation.

As described above, according to the present embodiment, as shown in FIG. 5, when the direct-coupled gear 100 rotates clockwise to raise the sheet of paper 3, the end 103*a* of the coil spring 103 rotates in a direction in which the coil spring 103 is wound around the rotational shaft 15. As the amount of paper 3 mounted on the paper pressing plate 8 decreases, the angle at which the direct-coupled gear 100 rotates increases. In other words, the elastic force generated by the coil spring 103 increases proportionally as the amount of paper 3 mounted on the paper pressing plate 8 decreases. According to the present embodiment, the spring modulus of the coil spring 8 is determined dependently on the allowable maximum total weight of paper 3 that can be mounted on the paper pressing plate 8. Accordingly, irrespective of the total weight of the paper 3 on the paper pressing plate 8, the total force applied on the direct-coupled gear 100 can be made unchanged, and therefore the speed at which the paper 3 rises can be made unchanged. It is therefore possible to restrain variations in the position, at which the topmost sheet 3 on the paper pressing plate 8 will finally stop.

In this way, according to the present embodiment, the height, at which the paper pressing plate 8 reaches when the topmost sheet 3 reaches the target height, increases as the amount of sheets 3 on the paper pressing plate 8 decreases. The upward speed of the paper pressing plate 8 increases as the amount of sheets 3 in the stack on the paper pressing plate 8 decreases. The pressing force, which is generated by the coil spring 103 in a direction against the upward force generated by the DC motor 70 and which restrains the upward force, increases as the amount of the sheets of paper 3 mounted on the paper pressing plate 8 decreases. In other words, the pressing force by the coil spring 103 increases as the speed of uplift increases. This can restrain any variations in the height of the topmost sheet 3 that will possibly occur due to changes in the amount of sheets 3 stacked on the paper pressing plate 8.

A sum of the pressing force generated by the coil spring 103 and the total stack weight of the sheets of paper 3 placed on the paper pressing plate 8 will become constant when the topmost sheet 3 is positioned at the same height, regardless of any discrepancy in the total stack weight of the sheets of paper 3 placed on the paper pressing plate 8. In other words, in a state in which the topmost sheet 3 is at the same height, the resultant force (the uplifting forte generated by the DC motor 70, the total sheet stack weight, and the pressing force generated by the coil spring 103) acting in the vertical direction on the paper pressing plate 8 on which the sheets of paper 3 are placed is constant, regardless of any changes in the total stack weight of the sheets of paper 3. This ensures that the paper pressing plate 8 rises at the same speed when the topmost sheet 3 reaches the same height, regardless of the amount of sheets of paper 3 stacked thereon. This can restrain any variations in the height of the topmost sheet 3 that will possibly occur due to changes in the amount of sheets of paper 3 stacked on the paper pressing plate 8.

Even when the engagement of the output gear 73 and the input gear 74 is released as shown in FIG. 7, the pressing member 16 is held a predetermined spacing away from the bottom plate 90 of the paper cassette 6 by the resilient force of the coil spring 103, which acts counterclockwise in FIG. 7 (clockwise in FIG. 5). When the engagement between the output gear 73 and the input gear 74 is released to remove the paper cassette 6 from the main casing 2, the speed, at which the pressing member 16 falls downwardly, is reduced by the elastic force of the coil spring 103. Accordingly, an impact between the pressing member 16 and the bottom plate 90 of the paper cassette 6 can be restrained and unpleasant noises can be reduced.

According to the present embodiment, the detecting sensor 66 detects the position of the pickup roller 10, which comes into contact with the topmost sheet of paper 3 and which moves vertically in accordance with changes in the height of the topmost sheet 3. It is possible to prevent occurrence of damages to the sheets of paper 3 and to prevent deterioration in the sheet supply capability, in comparison with a case where the position of the topmost sheet 3 were detected by detecting whether the topmost sheet 3 comes into contact with some member that is fixed to the laser printer 1. Moreover, the pickup roller 10 can be utilized also as a conveyor roller for conveying the sheet of paper 3. Accordingly, it is possible to reduce the total number of components in the laser printer 1.

While the invention has been described in detail with reference to the specific embodiment thereof, it would be apparent to those skilled in the art that various changes and modifications may be made therein without departing from the spirit of the invention.

For example, in the above-described embodiment, the coil spring 103 can be attached to any gears 74, 101, and 102 other than the direct-coupled gear 100.

Various types of elastic member, such as rubber and a helical spring, can be used instead of the coil spring 103.

In the above-described embodiment, the one edge (rear edge) of the paper pressing plate 8 is pivotally supported to the bottom plate 90 of the paper cassette 6 and the other edge thereof (front edge) swings about the one edge (rear edge) when being pushed by the lifting or elevating mechanism 16. With this configuration, a large amount of change in position of the paper pressing plate 8 can be attained with respect to a unit drive amount of the DC motor 70.

However, other types of lifting or elevating mechanism may be employed so that the paper pressing plate 8 will rise by the driving force of the DC motor 70 while maintaining the horizontal attitude thereof, for example.

In the above-described embodiment, the paper cassette 6 can be removed from the main casing 2. However, the paper cassette 6 can be modified not to be removable from the main casing 2.

The pressing plate drive unit 68 having the DC motor 70 could be installed on the paper cassette 6 side.

The above-described embodiment and modifications can be applied to various types of image recording devices, other than the laser printer, such as a facsimile device and a multifunction device that is provided with a printer function and a scanner function, and the like.

In the above-described embodiment, the coil spring 103 applies a pressing force to the direct-coupled gear 100, which serves as a part of the lifting mechanism for lifting the paper pressing plate 8. However, the coil spring 103 may be modified to apply a downward pressing force to the paper pressing plate 8 itself. Various elastic members other than the coil spring 103 may be employed to apply the downward pressing force to the paper pressing plate 8.

A stepping motor can be used instead of the DC motor 70.

Various types of recording medium, such as OHP sheets, other than sheets of paper may be stacked on the paper pressing plate 8 and be supplied to the laser printer 1.

What is claimed is:

1. A recording medium supply device for supplying a recording medium to a main body of an image forming device so as to allow the image forming device to form an image on the recording medium, the recording medium supply device comprising:

a supply device casing;

a mounting plate that is supported in the supply device casing and that receives a recording medium in a stack thereon, at least a part of the mounting plate being movable vertically with respect to the supply device casing;

a lifting member that converts a driving force generated by a drive motor into an upward force to cause at least a part of the mounting plate to rise upwardly, thereby raising a topmost recording medium placed on the mounting plate to reach a predetermined target height;

a pressing member that applies at least one of the mounting plate and the lifting member with a pressing force against the upward force applied on the mounting plate, the strength of the pressing force increasing as the at least a part of the mounting plate rises, wherein the lifting member includes:

a transmission mechanism having a gear that converts the driving force from the drive motor into a first rotational force to rotate in a predetermined first rotational direction;

a rotational shaft that is provided in the supply device casing and that rotates in the predetermined first rotational direction by the first rotational force; and a L-shaped member that is provided on the rotational shaft and that pivots about the center of the rotational shaft in accordance with the rotation of the rotational shaft in the first rotational direction, to thereby come into contact with the mounting plate from below and push the mounting plate upward, wherein the pressing member includes an elastic member that deforms elastically against the first rotational force of the gear to generate an elastic force as the pressing force, and wherein the gear includes a direct-coupled gear that rotates integrally with the rotational shaft, the elastic member deforming elastically in abutment contact with the direct-coupled gear when the direct-coupled gear rotates integrally with the rotational shaft in the first rotational direction.

2. The recording medium supply device as claimed in claim 1, wherein when a height, at which the topmost recording medium is positioned, is unchanged, the pressing force, which the pressing member applies to the at least one of the mounting plate and the lifting member, increases in accordance with decrease in the total weight of the recording medium placed on the mounting plate from a predetermined maximum weight, thereby allowing, when the height, at which the topmost recording medium is positioned, is unchanged, a sum of the total weight of the recording medium and the pressing force to have a fixed amount regardless of changes in the total weight of the recording medium placed on the mounting plate.

3. The recording medium supply device as claimed in claim 2, wherein the predetermined maximum weight is equal to a total weight of a predetermined maximum amount of a recording medium of a predetermined maximum size that can be stacked on the mounting plate.

4. The recording medium supply device as claimed in claim 1, wherein the drive motor includes a direct current motor that generates the driving force upon being supplied with a direct current.

5. The recording medium supply device as claimed in claim 1, wherein the elastic member has an elastic modulus that allows, when a height, at which the topmost recording medium is positioned, is unchanged, the elastic member to generate the elastic force that increases linearly in accordance with decrease in the total weight of the recording medium placed on the mounting plate.

6. The recording medium supply device as claimed in claim 1, wherein when a linkage between the transmission mechanism and the drive motor is released, the gear rotates in a predetermined second rotational direction that is opposite to the first rotational direction to generate a second rotational force, to thereby allow the L-shaped member to descend, the elastic member deforming elastically against the second rotational force, to thereby hold the L-shaped member at a position separate from a base surface of the supply device casing.

7. The recording medium supply device as claimed in claim 1, wherein the elastic member includes a coil spring that is wound around the rotational shaft, the coil spring having two end portions, the two end portions being located between an engagement location provided on the gear and another engagement location provided on the supply device casing, and deforming elastically as the rotational shaft rotates in the first rotational direction to raise the mounting plate.

8. The recording medium supply device as claimed in claim 7, wherein the two end portions of the coil spring are fixed to the engagement location on the gear and the other engagement location on the supply device casing, respectively, and wherein when the linkage between the transmission mechanism and the drive motor is released, the gear rotates in a predetermined second rotational direction that is opposite to the first rotational direction to generate a second rotational force, to thereby allow the L-shaped member to descend, the coil spring deforming elastically against the second rotational force, to thereby hold the L-shaped member at a position separate from a base surface of the supply device casing.

9. The recording medium supply device as claimed in claim 1, wherein the mounting plate has a first edge and a second edge opposite to the first edge, the first edge being pivotably supported on the supply device casing and the second edge pivoting about the first edge.

10. A recording medium supply device for supplying a recording medium to a main body of an image forming device so as to allow the image forming device to form an image on the recording medium, the recording medium supply device comprising:

a supply device casing;

a mounting plate that is supported in the supply device casing and that receives a recording medium in a stack thereon, at least a part of the mounting plate being movable vertically with respect to the supply device casing;

a lifting member that converts a driving force generated by a drive motor into an upward force to cause at least a part of the mounting plate to rise upwardly, thereby raising a topmost recording medium placed on the mounting plate to reach a predetermined target height;

a pressing member that applies at least one of the mounting plate and the lifting member with a pressing force against the upward force applied on the mounting plate, a sum of the total weight of the recording medium and the pressing force being unchanged regardless of changes in the total weight of the recording medium placed on the mounting plate when a height, at which the topmost recording medium is positioned, is unchanged, wherein the lifting member includes:

a transmission mechanism having a gear that converts the driving force from the drive motor into a first rotational force to rotate in a predetermined first rotational direction;

a rotational shaft that is provided in the supply device casing and that rotates in the predetermined first rotational direction by the first rotational force; and a L-shaped member that is provided on the rotational shaft and that pivots about the center of the rotational shaft in accordance with the rotation of the rotational shaft in the first rotational direction, to thereby come into contact with the mounting plate from below and push the mounting plate upward, wherein the pressing member includes an elastic member that deforms elastically against the first rotational force of the gear to generate an elastic force as the pressing force, and wherein the gear includes a direct-coupled gear that rotates integrally with the rotational shaft, the elastic member deforming elastically in abutment contact with the direct-coupled gear when the direct-coupled gear rotates integrally with the rotational shaft in the first rotational direction.

11. The recording medium supply device as claimed in claim 10, wherein when the height, at which the topmost recording medium is positioned, is unchanged, the pressing force, which the pressing member applies to the at least one of the mounting plate and the lifting member, increases in accordance with a decrease in the total weight of the recording medium placed on the mounting plate from a predetermined maximum weight, the predetermined maximum weight being equal to a total weight of a predetermined maximum amount of the recording medium of a predetermined maximum size that can be stacked on the mounting plate.

12. The recording medium supply device as claimed in claim 10, wherein the elastic member has an elastic modulus that allows, when a height, at which the topmost recording medium is positioned, is unchanged, the elastic member to generate an elastic force that increases linearly in accordance with a decrease in the total weight of the recording medium placed on the mounting plate.

13. The recording medium supply device as claimed in claim 10, wherein when a linkage between the transmission mechanism and the drive motor is released, the gear rotates in a predetermined second rotational direction that is opposite to the first rotational direction to generate a second rotational force, to thereby allow the L-shaped member to descend, the elastic member deforming elastically against the second rotational force, to thereby hold the L-shaped member at a position separate from a base surface of the supply device casing.

14. The recording medium supply device as claimed in claim 10, wherein the elastic member includes a coil spring that is wound around the rotational shaft, the coil spring having two end portions, the two end portions of the coil spring being fixed to an engagement location defined on the gear and another engagement location defined on the supply device casing, respectively, and wherein when a linkage between the transmission mechanism and the drive motor is released, the gear rotates in a predetermined second rotational direction that is opposite to the first rotational direction to generate a second rotational force, to thereby allow the L-shaped member to descend, the coil spring deforming elastically against the second rotational force, to thereby hold the L-shaped member at a position separate from a base surface of the supply device casing.

15. An image forming device, comprising:

a main unit that forms an image on a recording medium;

a recording medium supply device that supplies the recording medium to the main unit, the recording medium supply device including:

a supply device casing;

a mounting plate that is supported in the supply device casing and that receives a recording medium in a stack thereon, at least a part of the mounting plate being movable vertically with respect to the supply device casing;

a lifting member that converts a driving force generated by a drive motor into an upward force to cause at least a part of the mounting plate to rise upwardly, thereby raising a topmost recording medium placed on the mounting plate to reach a predetermined target height; and a pressing member that applies at least one of the mounting plate and the lifting member with a pressing force against the upward force applied on the mounting plate, the strength of the pressing force increasing as the at least a part of the mounting plate rises, wherein the drive motor is provided in either one of the main unit and the recording medium supply device, the drive motor generating a driving force, wherein a control device is provided in either one of the main unit and the recording medium supply device, the control device controlling the drive motor to stop generating the driving force when the topmost recording medium placed on the mounting plate reaches the predetermined target height, wherein the lifting member includes:

a transmission mechanism having a gear that converts the driving force from the drive motor into a first rotational force to rotate in a predetermined first rotational direction;

a rotational shaft that is provided in the supply device casing and that rotates in the predetermined first rotational direction by the first rotational force; and a L-shaped member that is provided on the rotational shaft and that pivots about the center of the rotational shaft in accordance with the rotation of the rotational shaft in the first rotational direction, to thereby come into contact with the mounting plate from below and push the mounting plate upward, wherein the pressing member includes an elastic member that deforms elastically against the first rotational force of the gear to generate an elastic force as the pressing force, and wherein the gear includes a direct-coupled gear that rotates integrally with the rotational shaft, the elastic member deforming elastically in abutment contact with the direct-coupled gear when the direct-coupled gear rotates integrally with the rotational shaft in the first rotational direction.

16. The image forming device as claimed in claim 15, wherein the drive motor includes a direct current motor, the control device stops supplying the direct current motor with a direct current, thereby controlling the direct current motor to stop generating the driving force.

17. The image forming device as claimed in claim 15, further comprising:

a conveyor roller that is placed in contact with the topmost recording medium from above and that is capable of moving vertically in accordance with changes in the height of the topmost recording medium; and a detection member that detects the position of the conveyor roller and issues a detection signal indicative of a detection result, wherein the control device controls the drive motor to stop generating the driving force on the basis of the detection signal.

* * * * *